US006145306A

United States Patent [19]

Takagi et al.

[11] Patent Number: 6,145,306

[45] Date of Patent: Nov. 14, 2000

[54] EXHAUST GAS PURIFYING OF LEAN-BURN INTERNAL COMBUSTION ENGINE

[75] Inventors: Naoya Takagi; Toshimi Murai, both of Susono; Yoshihiko Hyodo, Gotenba, all of Japan

[73] Assignee: Toyota Jidosha Kabushiki Kaisha, Tokyo, Japan

[21] Appl. No.: 09/229,177

[22] Filed: Jan. 13, 1999

[30] Foreign Application Priority Data

Jan. 23, 1998 [JP] Japan ..... 10-011855

[51] Int. Cl.[7] ..... F01N 3/00

[52] U.S. Cl. ..... 60/283; 60/285; 60/286; 60/301

[58] Field of Search ..... 60/283, 285, 286, 60/301

[56] References Cited

U.S. PATENT DOCUMENTS

| | | | |
|---|---|---|---|
| 4,130,095 | 12/1978 | Bowler et al. | 123/32 |
| 5,111,796 | 5/1992 | Ogita . | |
| 5,174,111 | 12/1992 | Nomura et al. | 60/285 |
| 5,245,975 | 9/1993 | Ito . | |
| 5,305,724 | 4/1994 | Chikamatsu et al. . | |
| 5,438,967 | 8/1995 | Ito . | |
| 5,609,135 | 3/1997 | Ogawa et al. . | |
| 5,613,481 | 3/1997 | Kitagawa et al. . | |
| 5,653,103 | 8/1997 | Katoh | 60/283 |
| 5,680,756 | 10/1997 | Harima | 60/277 |

FOREIGN PATENT DOCUMENTS

| | | | |
|---|---|---|---|
| 4402588 | 1/1994 | Germany . | |
| 19538786 | 10/1995 | Germany . | |
| 03258961 | 11/1991 | Japan | 123/519 |
| 04060163 | 2/1992 | Japan | 123/395 |
| 4-194354 | 7/1992 | Japan . | |
| 4-295150 | 10/1992 | Japan . | |
| 04353254 | 12/1992 | Japan | 123/519 |
| 405033733 | 2/1993 | Japan | 123/519 |
| 5-71430 | 3/1993 | Japan . | |
| 5-223017 | 8/1993 | Japan . | |
| 6-137190 | 5/1994 | Japan . | |
| 6-147033 | 5/1994 | Japan . | |
| 6-173660 | 6/1994 | Japan . | |
| 6-200794 | 7/1994 | Japan . | |
| 6-212961 | 8/1994 | Japan . | |
| 8-177572 | 7/1996 | Japan . | |

*Primary Examiner*—Thomas Denion
*Assistant Examiner*—Diem Tran
*Attorney, Agent, or Firm*—Oliff & Berridge, PLC

[57] ABSTRACT

An exhaust gas purifying apparatus of a lean-burn internal combustion engine surely purifies nitrogen oxide occluded by a nitrogen oxide occluding/reducing catalyst without making a combustion of an air-fuel mixture unstable while utilizing a vapor fuel generated in a fuel tank. The exhaust gas purifying apparatus includes a gas state judging unit for judging a state of a vapor fuel gas supplied to an intake system of the lean-burn internal combustion engine, and an exhaust state control unit for setting, to a desired state, a state of the exhaust gas flowing to the nitrogen oxide occluding/reducing catalyst by selectively controlling the fuel injection valve and the gas supply unit in accordance with a state of the vapor fuel gas at the time when the nitrogen oxide occluded by the nitrogen oxide occluding/reducing catalyst provided in an exhaust system of the lean-burn internal combustion engine should be desorbed and purified.

6 Claims, 7 Drawing Sheets

EXHAUST GAS PURIFYING OF LEAN-BURN INTERNAL COMBUSTION ENGINE

BACKGROUND OF THE INVENTION

The present invention relates generally to a technology of purifying an exhaust gas of a lean-burn internal combustion engine capable of burning an air-fuel mixture in an oxygen excessive state and, more particularly a technology of purifying the exhaust gas of the lean-burn internal combustion engine having a nitrogen oxide occluding/reducing catalyst disposed in an exhaust system.

In the field of the internal combustion engine mounted in an automobile and the like, for reducing a quantity of fuel burned, there has been increasingly developed the lean-burn internal combustion engine capable of burning the air-fuel mixture in which an air-fuel ratio is higher than a theoretical air/fuel ratio (which means an oxygen excessive state). What is known as this type of lean-burn internal combustion engine is a so-called intake port injection type lean-burn internal combustion engine including an intake port formed to generate a tumble flow or a swirl flow of the air-fuel mixture flowing into a combustion chamber, and a fuel injection valve so attached that an injection port thereof faces the intake port.

With the intake port injection type lean-burn internal combustion engine, the fuel is injected out of the fuel injection valve at the latter stage of an exhaust stroke through the early stage of an intake stroke, and is uniformly mixed with fresh air at the intake port, thus flowing into the combustion chamber. On this occasion, the air-fuel mixture forms the tumble flow or the swirl flow. Then, when the air-fuel mixture is ignited by a spark plug, flames in the vicinity of the spark plug diffuse over within the combustion chamber along the tumble flow or the swirl flow, and the combustion of the air-fuel mixture in the lean state is speeded up.

In the intake port injection type lean-burn internal combustion engine, the air-fuel mixture with the fuel and the fresh air being substantially uniformly mixed with each other, is introduced into the combustion chamber. Therefore, as a fuel concentration is made much leaner by reducing the fuel injection quantity, the fuel concentration in the vicinity of the spark plug becomes leaner, with the result that the ignition by the spark plug becomes impossible.

By contrast, there has been increasingly developed a cylinder injection type lean-burn internal combustion engine having the fuel injection valve so attached that the injection port thereof faces the combustion chamber. In the cylinder injection type internal combustion engine, the fresh air is introduced into the combustion chamber by the intake stroke, and subsequently the fuel is injected from the fuel injection valve by a compression stroke, thereby forming the air-fuel mixture combustible only in the vicinity of the spark plug. At this time, there is formed a combustible air-fuel mixture layer in the vicinity of the spark plug in the combustion chamber of the internal combustion engine, and air layers are formed in other regions, whereby a so-called stratified state occurs. The thus stratified air-fuel mixture is burned, wherein the combustible air-fuel mixture in the vicinity of the spark plug serves as an ignition source.

Accordingly, the cylinder injection type lean-burn internal combustion engine is capable of making the fuel concentration within the entire combustion chamber leaner than by the intake port injection type lean-burn internal combustion engine, and providing both reduction of fuel consumption and the stable combustion state.

On the other hand, the exhaust system of the internal combustion engine is provided with a ternary catalyst for purifying HC, CO and $NO_x$ in the exhaust gas. The ternary catalyst is constructed to efficiently oxidize HC and CO when the air/fuel ratio of the exhaust gas falls within a predetermined range of the theoretical air/fuel ratio, and efficiently reduces $NO_x$. Hence, when the lean-burn is carried out in the above-described lean-burn internal combustion engine, an oxygen concentration in the exhaust gas increases, and the air/fuel ratio of the exhaust gas increases higher than the predetermined range described above. Then, the ternary catalyst, while it can oxidize HC and CO, is incapable of reducing $NO_x$ sufficiently.

Such being the case, the nitrogen oxide occluding/reducing catalyst is disposed in the exhaust system of the lean-burn internal combustion engine. The nitrogen oxide occluding/reducing catalyst has such characteristics as to occlude nitrogen oxide ($NO_x$) present in the exhaust gas when in a so-called lean state where the oxygen concentration of the exhaust gas flowing in is high, and to desorb the occluded nitrogen oxide ($NO_x$) by making the nitrogen oxide ($NO_x$) react to carbon monoxide (CO) and hydro carbon (HC) in the exhaust gas and reducing it into nitrogen ($N_2$) when the oxygen concentration of the exhaust gas flowing in decreases while the hydro carbon (HC) increases.

In the lean-burn internal combustion engine having the nitrogen oxide occluding/reducing catalyst, the nitrogen oxide occluding/reducing catalyst absorbs the nitrogen oxide ($NO_x$) contained in the exhaust gas when in the lean-burn process, and reduction components (carbon monoxide (CO) and hydro carbon (HC)) in the exhaust gas are increased before the nitrogen oxide ($NO_x$) absorption quantity of the nitrogen oxide occluding/reducing catalyst is saturated, thus effecting a so-called rich spike, then, it is required that the exhaust gas be thereby purified on the catalyst by desorbing the nitrogen oxide ($NO_x$) occluded by the nitrogen oxide occluding/reducing catalyst.

As an apparatus for efficiently desorbing and purifying the nitrogen oxide ($NO_x$) occluded by the nitrogen oxide occluding/reducing catalyst, there is known an exhaust gas purifying apparatus of an internal combustion engine which is disclosed in Japanese Patent Application Laid-Open Publication No.6-173660.

This prior art exhaust gas purifying apparatus of the internal combustion engine is so designed, in the intake port injection type lean-burn internal combustion engine, to desorb and purify the nitrogen oxide ($NO_x$) occluded by the nitrogen oxide occluding/reducing catalyst by injecting from the fuel injection valve the same quantity of fuel as when forming the air-fuel mixture in the oxygen excessive state, and, at the same time, introducing the gas containing a vapor fuel generated in a fuel tank into an exhaust passageway disposed upstream of the nitrogen oxide occluding/reducing catalyst and into an intake system of the internal combustion engine, and thereby to increase hydro carbon (HC) in the exhaust gas flowing into the nitrogen oxide occluding/reducing catalyst.

The exhaust gas purifying apparatus described above does not take into consideration a quantity and a concentration of the vapor fuel, or a time required for the vapor fuel actually arrives at the nitrogen oxide occluding/reducing catalyst from the time of starting a supply of the vapor fuel. Thus, this exhaust gas purifying apparatus is not only incapable of supplying the nitrogen oxide occluding/reducing catalyst with the exhaust gas containing a desired quantity of reduction components, but also incapable of supplying the nitrogen oxide occluding/reducing catalyst with the exhaust gas containing the reduction components at a desired timing. As a result, the nitrogen oxide ($NO_x$) occluded by the nitrogen oxide occluding/reducing catalyst is not sufficiently desorbed and purified, and the nitrogen oxide occluding/reducing catalyst becomes the saturated state, with the result that the nitrogen oxide ($NO_x$) is released into the atmospheric air without being purified and an exhaust emission might be worsened.

In the case of applying the exhaust gas purifying apparatus described above to the cylinder injection type lean-burn internal combustion engine, especially when the vapor fuel is supplied during the stratified combustion process, the interior of the combustion chamber cannot be made in the stratified sate. This might cause possibilities that the combustion becomes unstable, the fuel concentration in the vicinity of the spark plug becomes higher than needed, which causes failure of ignition by the spark plug, and thus, results in an accidental fire.

SUMMARY OF THE INVENTION

It is a primary object of the present invention, which was devised to overcome the above-described problems, to provide a technology capable of reliably purifying nitrogen oxide ($NO_x$) occluded by the nitrogen oxide occluding/reducing catalyst by utilizing the vapor fuel generated in the fuel tank without making the combustion state unstable, and actualizing both prevention of worsen of the exhaust emission and an efficient process of the vapor fuel in the lean-burn internal combustion engine.

To accomplish the above object, the present invention adopts the following construction.

According to the present invention, an exhaust gas purifying apparatus of a lean-burn internal combustion engine comprises: a lean-burn internal combustion engine capable of burning an air-fuel mixture in an oxygen excessive state; gas supply means for supplying an intake system of the lean-burn internal combustion engine with a vapor fuel gas containing a vapor fuel generated in a fuel tank; a nitrogen oxide occluding/reducing catalyst, provided in an exhaust system of the lean-burn internal combustion engine, for occluding nitrogen oxide in an exhaust gas when the exhaust gas is in the oxygen excessive state, and purifying the occluded nitrogen oxide when an oxygen concentration in the exhaust gas decreases; gas state judging means for judging a state of the vapor fuel gas supplied to the intake system of the lean-burn internal combustion engine; and an exhaust state control means for setting an air/fuel ratio of the exhaust gas flowing to the nitrogen oxide occluding/reducing catalyst to a desired state by selectively controlling a fuel injection valve of the lean-burn internal combustion engine and the gas supplying means in accordance with the state of the vapor fuel gas which is judged by the gas state judging means at a timing when the nitrogen oxide occluded by the nitrogen oxide occluding/reducing catalyst is to be purified.

According to the thus constructed exhaust gas purifying apparatus, the gas state judging means judges a state of the vapor fuel gas, when executing the so-called rich spike control for purifying the nitrogen oxide occluded by the nitrogen oxide occluding/reducing catalyst.

As the state of the vapor fuel gas, there may be exemplified, e.g., a fuel concentration in the vapor fuel gas, a flow rate of the vapor fuel gas, a flow velocity of the vapor fuel gas (the time required for the vapor fuel gas to arrive at the nitrogen occluding/reducing catalyst) and the like.

Then, the exhaust gas state control means selectively controls the fuel injection valve and the gas supply means of the lean-burn internal combustion engine in accordance with the vapor fuel gas state judged by the gas state judging means at the timing when the nitrogen oxide occluded by the nitrogen oxide occluding/reducing catalyst should be purified. With this control, the combustion of the air-fuel mixture in the lean-burn internal combustion engine does not become unstable, the exhaust gas flowing into the nitrogen oxide occluding/reducing catalyst is to have a desired air/fuel ratio, and the nitrogen oxide occluded by the nitrogen oxide occluding/reducing catalyst is reliably purified.

Accordingly, the exhaust gas purifying apparatus of the present invention is capable of reliably purifying the nitrogen oxide occluded by the nitrogen oxide occluding/reducing catalyst by utilizing the vapor fuel generated in the fuel tank, and actualizing both the prevention of worsening the exhaust emission and providing an efficient process of the vapor fuel.

In the exhaust gas purifying apparatus of the lean-burn internal combustion engine according to present invention, the gas state judging means may include vapor fuel concentration judging means for judging a fuel concentration in the vapor fuel gas supplied by the gas supply means to the intake system of the lean-burn internal combustion engine, or gas supply quantity judging means for judging a quantity of the vapor fuel gas supplied by the gas supply means to the intake system of the lean-burn internal combustion engine, or gas arrival time judging means for judging a time required for the vapor fuel gas to arrive at the nitrogen oxide occluding/reducing catalyst from the time when the gas supply means has started supplying the vapor fuel gas to the intake system of the lean-burn internal combustion engine.

Also, the exhaust gas state control means may be so constructed to selectively control a period of time of fuel injection by the fuel injection valve, a fuel injection timing of the fuel injection valve, a supply quantity of the vapor fuel gas by the gas supply means, and a supply timing of the vapor fuel gas by the gas supply means.

Further, in the case where the lean-burn internal combustion engine may be a cylinder injection type lean-burn internal combustion engine including a fuel injection valve for injecting the fuel directly into a cylinder, the exhaust gas state control means may change the fuel injection timing of the fuel injection valve, when it is set at a compression stroke of each cylinder, to an intake stroke of each cylinder, i.e., may effect a changeover from the stratified combustion control to uniform combustion control in the case of purifying the nitrogen oxide occluded by the nitrogen oxide occluding/reducing catalyst.

These together with other objects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Other objects and advantages of the present invention will become apparent from the following discussion in conjunction with the accompanying drawings, in which.

DESCRIPTION OF THE PREFERRED EMBODIMENTS

[Embodiments]

Embodiments of an exhaust gas purifying apparatus of a lean-burn internal combustion engine according to the present invention will hereinafter be described with reference to the accompanying drawings.

Figure 1:
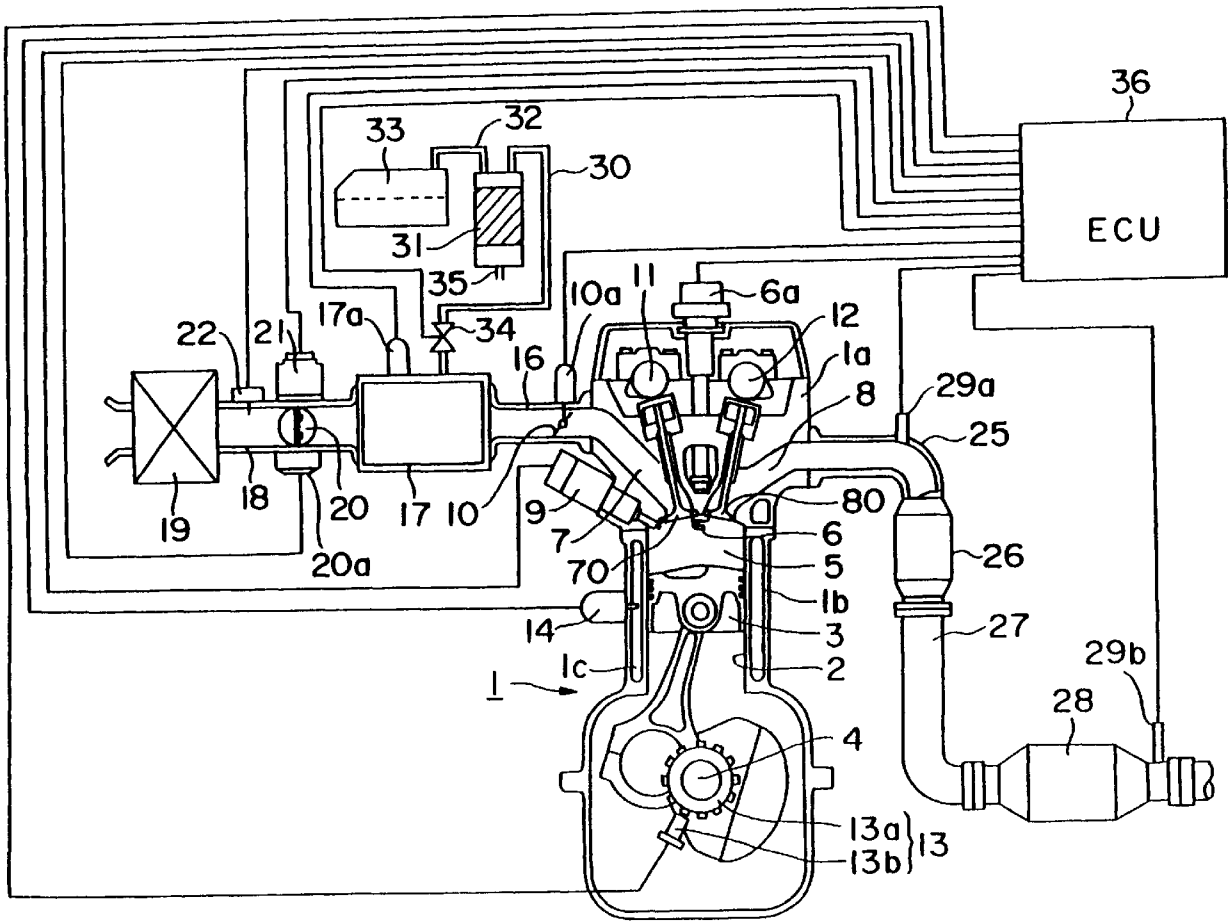
FIG. 1 is a diagram schematically illustrating a construction of an internal combustion engine to which an exhaust gas purifying apparatus of the present invention is applied.

FIG. 1 is a view schematically showing a construction of an internal combustion engine to which the exhaust gas purifying apparatus of the present invention is applied, and a construction of an intake/exhaust system thereof. The internal combustion engine shown in FIG. 1 is a 4-cycle cylinder fuel injection type internal combustion engine 1 including a plurality of cylinders and a fuel injection valve for injecting a fuel directly into each cylinder.

The internal combustion engine 1 has a cylinder block 1*b* formed with a plurality of cylinders 2, and a cylinder head 1*a* fixed to an upper portion of the cylinder block 1*b*.

A piston 3 slidable in an axial direction is inserted into each of the cylinders 2 of the cylinder block 1*b*, and this piston 3 is connected to a crank shaft 4 defined as an engine output shaft. A combustion chamber 5 surrounded by a top surface of the piston 3 and the cylinder head 1*a* is formed over the piston 3.

A spark plug 6 is so attached to the cylinder head 1*a* to face the combustion chamber 5, and an igniter 6*a* is attached to the spark plug 6 for applying a drive current thereto. The cylinder head 1*a* is so formed with open ends of two intake ports 7 and open ends of two exhaust ports 8 as to face the combustion chamber 5, and a fuel injection valve 9 is so attached to the cylinder head 1*a* that an injection port thereof faces the combustion chamber 5.

An intake valve 70 and an exhaust valve 80 for opening and closing the open ends of the intake and exhaust ports 7, 8, are so supported on the cylinder head 1*a* as to make advancing and retreating movements. An intake-side cam shaft 11 and an exhaust-side cam shaft 12 for opening and closing these intake and exhaust valves 70, 80, are rotatably supported on the cylinder head 1*a*.

The intake-side cam shaft 11 and the exhaust-side cam shaft 12 are connected to the crank shaft 4 via an unillustrated timing belt, whereby a rotational torque of the crank shaft 4 is transmitted via the timing belt to the intake-side cam shaft 11 and the exhaust-side cam shaft 12.

The internal combustion engine 1 includes a crank position sensor 13 consisting of a timing rotor 13*a* fitted to an end of the crank shaft 4 and of an electromagnetic pick-up 13*b* attached to the cylinder block 1*b*. Further, a water temperature sensor 14 is attached to the cylinder block 1*b*, for outputting an electric signal corresponding to a temperature of cooling water flowing through a cooling water passageway 1*c* which is formed in the cylinder block 1*b*.

Next, one of the two intake ports 7 is a straight port constructed of a passageway extending straight from the open end formed in an outer wall of the cylinder head 1*a* to the open end facing the combustion chamber 5. The other intake port 7 is a helical port constructed of a passageway helically extending from the open end in the outer wall of the cylinder head 1*a* to an opening formed inwardly of the open end of the combustion chamber 5.

The respective intake ports 7 communicate with intake branch pipes 16 attached to the cylinder head 1*a*. Of these branch pipes 16, the branch pipe communicating with the straight port is provided with a swirl control valve 10 for opening and closing the passageway within the branch pipe. Secured to the swirl control valve 10 is an actuator 10*a* constructed of a step motor and the like, for opening and closing the swirl control valve 10 in accordance with an applied current.

The intake branch pipe 16 is connected to a surge tank 17 which is connected via an intake pipe 18 to an air cleaner box 19.

An intake pipe 18 is provided with a throttle valve 2C for controlling an intake air flow rate within the intake pipe 18. Attached to the throttle valve 20 are an actuator 21 constructed of a step motor or the like and a throttle position sensor 20*a* for outputting an electric signal corresponding to a degree of opening of the throttle valve 20.

An air flow meter 22 for outputting an electric signal corresponding to a mass of fresh air (which is referred to as an intake air mass) flowing through within the intake pipe 18, is disposed at a portion, located upstream of the throttle valve 20, of the intake pipe 18.

The surge tank 17 is fitted with a vacuum sensor 17*a* for outputting an electric signal corresponding to a pressure in the surge tank 17. A purging passageway 30 is connected to the surge tank 17. The purging passageway 30 is connected to a charcoal canister 31. An electromagnetic valve 34 for controlling a flow rate in the purging passageway 30, is attached to a portion located midway of the purging passageway 30. The electromagnetic valve 34 is opened and closed in response to a drive pulse signal corresponding to a duty ratio indicating a ratio of a valve open time to a valve closing time.

A vapor fuel passageway 32 and an atmospheric air introducing passageway 35 are connected to the charcoal canister 31. The vapor fuel passageway 32 is connected to a fuel tank 33, and an open end of the atmospheric air introducing passageway 35 is disposed in the atmospheric air.

Herein, when the electromagnetic valve 34 is closed, a vapor fuel produced in the fuel tank 33 is introduced via the vapor fuel passageway 32 into the charcoal canister 31 and adsorbed to an adsorbent such as activated carbon and the like incorporated in the charcoal canister 31. Then, when the electromagnetic valve 34 is opened, an intake pipe negative pressure generated in the surge tank 17 is applied to the charcoal canister 31 via the purging passageway 30. The atmospheric air is thereby sucked via the atmospheric air introducing passageway 35 into the charcoal canister 31. The atmospheric air sucked into the charcoal canister 31 is then sucked into the surge tank 17 via the purging passageway 30. Thus, when the electromagnetic valve 34 is opened, there occurs a flow of the atmospheric air flowing through the charcoal canister 31.

The above described cross-flow of the atmospheric air causes desorption of the vapor fuel adsorbed to the adsorbent in the charcoal canister 31 from the adsorbent, and the vapor fuel is led, together with the atmospheric air, to the surge tank 17. Both the vapor fuel and the atmospheric air led to the surge tank 17 (the vapor fuel and the atmospheric air led from the purging passageway 30 to the surge tank 17 are hereinafter referred collectively to a vapor fuel gas), are sucked into the combustion chamber 5 of each cylinder 2 while being mixed with the fresh air introduced into the surge tank 17 via the air cleaner box 19 and the intake pipe 18. The vapor fuel gas is then burned with the fuel injected from the fuel injection valve 9 and subjected to a treatment, whereby the so-called vapor fuel gas purging is actualized.

Thus, the purging passageway 30, the electromagnetic valve 34 and the charcoal canister 31 actualize gas supply means according to the present invention.

On the other hand, the exhaust port 8 communicates with an exhaust branch pipe 25 fitted to the cylinder head 1*a*. This exhaust branch pipe 25 is connected via a first catalyst 26 to an exhaust pipe 27. The exhaust pipe 27 is connected at its downstream to an unillustrated silencer.

A first air/fuel ratio sensor 29*a* for outputting an electric signal corresponding to an air/fuel ratio of the exhaust gas flowing through within the exhaust branch pipe 25, is attached to a portion, disposed upstream of the first catalyst 26, of the exhaust pipe 25.

A second catalyst 28 is disposed at midway of the exhaust pipe 27. A second air/fuel ratio sensor 29*b* for outputting an electric signal corresponding to an air/fuel ratio of the exhaust gas flowing out of the second catalyst 28, is attached to a portion, disposed downstream of the second catalyst 28, of the exhaust pipe 27.

Herein, the first catalyst 26 is a ternary catalyst having a capacity smaller than the second catalyst 28. The second catalyst 28 is a nitrogen oxide occlusion/reducing type catalyst (hereinafter referred to as an $NO_x$ occluded catalyst 28) which is constructed, with, e.g., aluminum as a catalyst support carrying thereon at least one substance selected from alkali metal such as potassium K, sodium Na, lithium Li and cesium Cs; alkali earth such as barium Ba and calcium Ca; and rare earth such as lanthanum La, yttrium Y and the like, and a precious metal such as platinum Pt and the like.

A ratio of the air (oxygen $O_2$) in the exhaust gas flowing into the $NO_x$ occluded catalyst 28 to the fuel (hydro carbon HC) is termed an exhaust air/fuel ratio. This exhaust air/fuel ratio corresponds to an air/fuel ratio of an air-fuel mixture supplied to the combustion chamber 5 if neither the fuel nor the air is supplied into the exhaust pipe 27 disposed upstream of the $NO_x$ occluded catalyst 28.

Then, the $NO_x$ occluded catalyst 28, when the exhaust gas air/fuel ratio (an air/fuel ratio of the air-fuel mixture) is in the oxygen excessive state, i.e., a so-called lean state, absorbs the nitrogen oxide $NO_x$ in the exhaust gas, and desorbs the absorbed nitrogen oxide $NO_x$ when in a state where a concentration of hydro carbon (HC) is high with a decreased oxygen concentration in the exhaust gas (in the air-fuel mixture), i.e., when in a rich state.

To be specific, in the case of the $NO_x$ occluded catalyst with platinum Pt and barium Ba carried on the catalyst support, when the exhaust gas air/fuel ratio becomes the lean state, oxygen $O_2$ in the exhaust gas is adhered to the surface of platinum Pt in the form of $O_2^-$ or $O_2^{2-}$. On the other hand, the nitrogen oxide $NO_x$ in the exhaust gas reacts to $O_2^-$ or $O_2^{2-}$ on the surface of platinum Pt, thereby becoming $NO_2$ ($2NO+O_2 \rightarrow 2NO_2$). $NO_2$ thus produced and $NO_2$ in the exhaust gas are, while being oxidized on platinum Pt, coupled with barium oxide BaO and becomes sodium ion $NO_3^-$.

Subsequently, when the concentration of oxygen in the exhaust gas flowing into the $NO_x$ occluded catalyst decreases, a generation quantity of $NO_2$ in the $NO_x$ occluded catalyst decreases, and the reaction advances in the reverse direction ($NO_3 \rightarrow NO_2$), and the sodium ion $NO_3^-$ is released in the form of $NO_2$. $NO_2$ thus released reacts to reducing components (HC, CO, $O_2$) in the exhaust gas on the $NO_x$ occluded catalyst 28 and is reduced to nitrogen $N_2$.

Next, the internal combustion engine 1 incorporates an electronic control unit (ECU) 36 for controlling an operation of the internal combustion engine 1.

Connected via electric wires to the ECU 36 are various sensors such as the crank position sensor 13, the water temperature sensor 14, the vacuum sensor 17*a*, the throttle position sensor 20*a*, the air flow meter 22 and first and second air/fuel ratio sensors 29*a*, 29*b*. Output signals of the various sensors are inputted to the ECU 36.

In addition to the above sensors, the igniter 6*a*, the fuel injection valve 9, the actuator 10*a*, the actuator 21 and the electromagnetic valve 34 are connected via electric wires to the ECU 36. The ECU 36, with the output signals from the various sensors serving as parameters, judges an operation state of the internal combustion engine 1, a vapor fuel occluded state in the charcoal canister 31 and a nitrogen oxide $NO_x$ occluded quantity of the $NO_x$ occluded catalyst 28, and, based on results of these judgements, controls the igniter 6*a*, the fuel injection valve 9, the actuator 10*a*, the actuator 21 and the electromagnetic valve 34.

Figure 2:
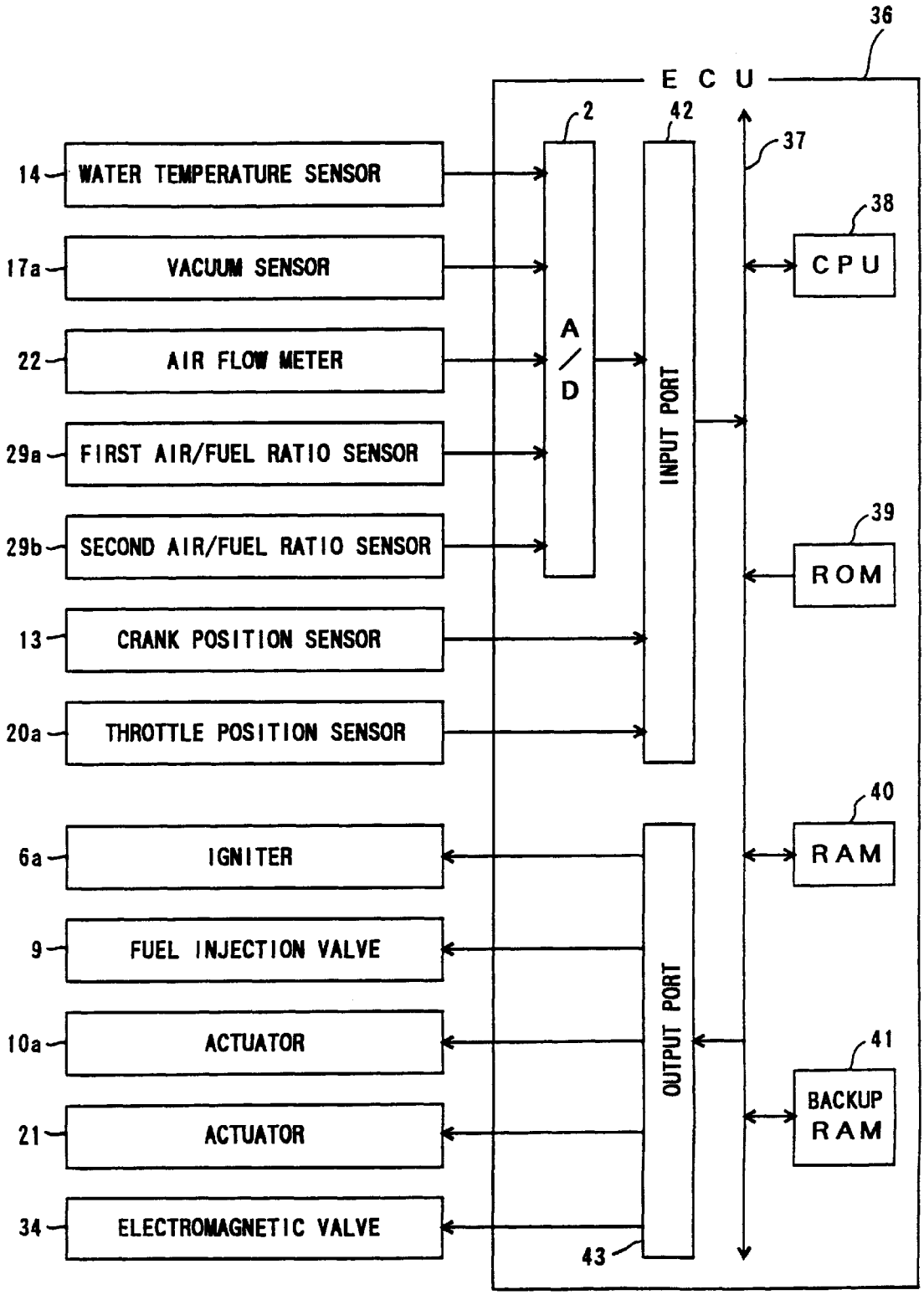
FIG. 2 is a diagram showing an internal construction of an ECU.

Herein, the ECU 36, as shown in FIG. 2, includes a CPU 38, a ROM 39, a RAM 40, a backup RAM 41, an input port 42 and an output port 43, which are connected to one another via a bidirectional bus 37. The ECU 36 also includes an A/D converter (A/D) 44 connected to the input port 42.

The input port 42 inputs signals from the crank position sensor 13 and the throttle position sensor 20*a*, and transmits these signals to the CPU 38 or the RAM 40. The input port 42 inputs via the A/D converter 44 signals from the water temperature sensor 14, the vacuum sensor 17*a*, the air flow meter 22 and the first and second air/fuel ratio sensors 29*a*, 29*b*, and transmits these signals to the CPU 38 or the RAM 40.

The output port 43 outputs a control signal from the CPU 38 to the igniter 6*a*, the fuel injection valve 9, the actuator 10*a*, the actuator 21 and the electromagnetic valve 34.

The ROM 39 stores therein various control maps and application programs for a fuel injection quantity control routine for determining a fuel injection quantity, a fuel injection timing control routing for determining a fuel injection timing, an ignition timing control routine for determining an ignition timing, or a nitrogen oxide purifying control routine for desorbing and simultaneously purifying the nitrogen oxide $NO_x$ occluded in the $NO_x$ occluded catalyst 28.

Exemplified as the control maps stored in the ROM 39 are, e.g., a fuel injection quantity control map indicating a relationship between the operation state of the internal combustion engine 1 and the fuel injection quantity, a fuel injection timing control map indicating a relationship between the operation state of the internal combustion engine 1 and the fuel injection timing, an ignition timing control map indicating a relationship between the operation state of the internal combustion engine 1 and the ignition timing, a purged gas arriving time control map indicating a relationship between a time (a purging gas arrival time) required for the vapor fuel gas to arrive at the $NO_x$ occluded catalyst 28 from the time of starting purging of the vapor fuel gas and the number of engine rotations, and a fuel injection timing compensation map indicating a relationship between the fuel injection quantity which should be increased at the time when the nitrogen oxide $NO_x$ occluded in the $NO_x$ occluded catalyst 28 should be purified, and a compensation quantity at the fuel injection timing.

The RAM 40 stores therein the output signals from various sensors and arithmetic results of the CPU 38. The arithmetic results are, for example, the number of engine rotations that is calculated from the output signal of the crank position sensor 13, a quantity of the vapor fuel that can be purged per unit time (which is referred to as a purged vapor quantity QV) from the charcoal canister 31 to the surge tank 17, and a fuel injection quantity (a fuel injection increased quantity QF) which should be increased when desorbing and purifying the nitrogen oxide $NO_x$. Then, the output signals from various sensors and the arithmetic results of the CPU 38 are rewritten to update the data each time the crank position sensor 13 outputs the signal.

The backup RAM 41 is a non-volatile memory for retaining the data even after the operation of the internal combustion engine 1 is stopped.

The CPU 38, which operates based on the application programs stored in the ROM 39, judges an operation state of the internal combustion engine 1 with reference to the output signals of the various sensors, and calculates the fuel injection quantity, the fuel injection timing, the ignition timing, the fuel injection increased quantity and compensation quantity at the fuel injection timing, from the operation state and various control maps. Then, the CPU 38, based on results of the calculations, controls the igniter 6*a*, the fuel injection valve 9, the actuator 10*a* and the actuator 21.

For instance, the CPU 38, when judging referring to the output signals of various sensors that the operation state of the internal combustion engine 1 is in a low-load operation region, decreases the degree of opening of the swirl control valve 10 by controlling the actuator 10*a* in order to actualize the stratified combustion, controls the throttle valve 20 by driving the actuator 21 so that the throttle valve 20 has the degree of opening to such an extent to obtain substantially the same intake flow rate as when fully opened, and performs the compression stroke injection by applying a drive current to the fuel injection valve 9 at the time when the compression stroke of each cylinder 2 is made. In this case, a combustible air-fuel mixture layer is formed only in the vicinity of the spark plug 6 within the combustion chamber of each cylinder 2, and air layers are formed in other regions. The air-fuel mixture of which the layer is thus formed is burned with the combustible air-fuel mixture layer serving as the ignition source, thereby actualizing the stratified combustion.

The CPU 38, when judging that the operation state of the engine is in an intermediate load operation region, in order to actualize a uniform combustion with the lean air-fuel mixture, decreases the degree of opening of the swirl control valve 10 by controlling the actuator 10*a*, and executes an intake stroke injection by applying the drive current to the fuel injection valve 9 at the time when an intake stroke of each cylinder 2 is made. On this occasion, the quantity of fuel injected from the fuel injection valve 9 is controlled so that a ratio of the fresh air to the fuel (air/fuel ratio) is higher than a theoretical air/fuel ratio and set to such an air/fuel ratio as to be ignitable by the spark plug 6. As a result, the lean air-fuel mixture of the air and the fuel being uniformly mixed, is formed over substantially the entire area in the combustion chamber 5 of each cylinder 2, thereby actualizing a uniform combustion.

The CPU 38, when judging that the operation state of the engine exists in a high load operation region, in order to actualize the uniform combustion with the air-fuel mixture in the vicinity of the theoretical air/fuel ratio, sets the swirl control valve 10 in a full-open state by controlling the actuator 10*a*, then controls the actuator 21 so that the throttle valve 20 has the degree of opening corresponding to a pedaling quantity of an unillustrated accelerator pedal, and further executes the intake stroke injection by applying the drive current to the fuel injection valve 9 at the time when the intake stroke of each cylinder 2 is made. In this case, the air-fuel mixture exhibiting the theoretical air/fuel ratio at which the air and the fuel are uniformly mixed, is formed over substantially the entire area in the combustion chamber 5 of each cylinder 2, thereby actualizing the uniform combustion.

Note that the CPU 38, when shifting from the stratified combustion control to the uniform combustion control and vice versa, applies the drive current twice to the fuel injection valve 9 separately at the time when the compression stroke of each cylinder 2 is made and at the time when the intake stroke thereof in order t0 prevent fluctuations in torque of the internal combustion engine 1. In this case, the combustible air-fuel mixture layer is formed in the vicinity of the spark plug 6, and the lean air-fuel mixture layers are formed in other regions, whereby the so-called weak stratified combustion is actualized.

Next, the CPU 38 in this embodiment is to include a rich spike execution counter for counting a value corresponding to the quantity of nitrogen oxide $NO_x$ occluded in the $NO_x$ occluded catalyst 28. This rich spike execution counter is a counter of which a value is incremented in response to the load of the internal combustion engine 1, the number of engine rotations, the fuel injection quantity and the like, and is constructed of a register and the like. The rich spike execution counter is reset upon completion of the execution of the rich spike control.

Further, a value of the rich spike execution counter at the time when the nitrogen oxide $NO_x$ occlusion quantity of the $NO_x$ occluded catalyst 28 reaches the saturated state, is previously obtained by tests, and a value A obtained by subtracting a predetermined quantity as a margin from the counter value thereof is set as the upper limit value of the rich spike execution counter.

The CPU 38, when the value of the rich spike execution counter reaches the upper limit value A, executes the rich spike in order to bring the air/fuel ratio of the exhaust gas into a desired state. More specifically, the CPU 38 actualizes the rich spike by compensating the increase quantity of the fuel injection quantity and by purging the vapor fuel gas.

It takes time for the vapor fuel gas to arrive at the $NO_x$ occluded catalyst 28 from the time of starting its purging, and hence the purging control of the vapor fuel and the increase quantity control of the fuel injection quantity are started just when the counter value of the rich spike execution counter reaches the predetermined value A, and in this case there occurs a time lag between the time required for the fuel injected from the fuel injection valve 9 to reach the $NO_x$ occluded catalyst 28 and the time required for the purged vapor fuel gas to arrive at the $NO_x$ occluded catalyst 28. It is therefore impossible to supply the $NO_x$ occluded catalyst 28 at a desired timing with the exhaust gas containing predetermined quantities of reducing components (HC, CO).

Such being the case, in accordance with this embodiment, the CPU 38 starts purging the vapor fuel gas at a point of time when the value of the rich spike execution counter reaches a value obtained by subtracting a value $\Delta A$ corresponding to the purged gas arriving time $\Delta t$ from the upper limit value A (A−ΔA), and controls the increase quantity of the fuel injection quantity at a point of time when the value of the rich spike execution counter reaches the upper limit value A. Thus, in this case, it follows that the increased quantity of injection fuel and the vapor fuel gas substantially simultaneously flow to the $NO_x$ occluded catalyst 28.

Figure 3:
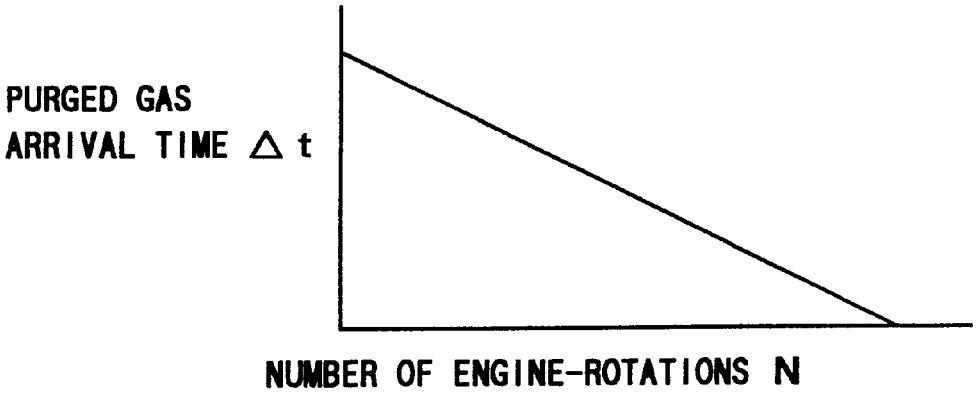
FIG. 3 is a graphic chart showing a specific example of a purged gas arrival time control map.

Note that the higher the flow velocity of the intake air of the internal combustion engine 1, the shorter the purged gas arriving time Δt becomes, and the greater the number of engine rotations, the higher the flow velocity of the intake air. Therefore, the CPU 38 calculates the number-of-engine-rotations N of the internal combustion engine 1, and, based on the purged gas arriving time control map as shown in FIG. 3, calculates the purged gas arriving time Δt corresponding to the number-of-engine-rotations N. The value ΔA is the value previously obtained by the tests, and is determined based on, e.g., the number of engine rotations and the purged gas arriving time which are used as parameters.

An increased fuel quantity (a rich spike fuel quantity QRS) necessary for desorbing and purifying the nitrogen oxide $NO_x$ occluded in the $NO_x$ occluded catalyst 28, is compensated by purging the vapor fuel and by the increased quantity of the fuel injection, in which case, the vapor fuel gas purging being principal, a fuel quantity deficient for purging the vapor fuel gas is to be compensated by the increased quantity of the fuel injection.

In this instance, the fuel injection quantity that should be increased changes according to the state of the vapor fuel gas to be purged, and the product (=QV·Tmax) of a vapor fuel quantity (a purged vapor quantity) QV per unit time which can be supplied from the charcoal canister 31 to the surge tank 17 and a maximum time (a maximum valve open time) Tmax during which the electromagnetic valve 34 is fully opened, and hence it is required that the increased quantity of the fuel injection quantity be determined after specifying the purged vapor quantity QV.

The purged vapor quantity QV is a value obtained by multiplying a fuel concentration CP in the vapor fuel gas to be purged by a vapor fuel gas flow rate (a purged gas flow rate QP) per unit time. Then, the purged gas flow rate QP changes in response to a differential pressure ΔP between an intake pipe pressure generated in the surge tank 17 and the atmospheric pressure. However, in the case of executing lean-burn combustion control (stratified combustion control) in the cylinder injection type internal combustion engine 1 as exemplified in this embodiment, the throttle valve 20 is controlled to have substantially the same intake air flow rate as that in the full-open state, except the time of an extremely low load, and, therefore, the intake pipe negative pressure becomes substantially constant. As a result, the differential pressure ΔP also becomes constant, and hence the purged gas flow rate QP becomes constant.

As a method of specifying the fuel concentration CP, there may be exemplified a method of calculating the fuel concentration of the vapor fuel gas, when implementing the normal purging control, from a difference between an output signal value of the first air/fuel ratio sensor 29*a* just before executing the purging process and an output signal value of the first air/fuel ratio sensor 29*a* when executing the purging process, and utilizing the thus calculated fuel concentration as a learning value, or a method of directly detecting the fuel concentration by using an HC sensor fitted to the charcoal canister 31 or the purging passageway 30.

The CPU 38 calculates the purged vapor quantity QV by multiplying the calculated fuel concentration CP by the purged gas flow rate QP, subsequently multiplying the purged vapor quantity QV by the maximum electromagnetic valve open time Tmax, and thus calculating the quantity of fuel (purged fuel quantity QV·Tmax) that can be supplied from the charcoal canister 31 to the surge tank 17. Subsequently, the CPU 38 compares the calculated purged fuel quantity QV·Tmax with the rich spike fuel quantity QRS.

If the purged fuel quantity QV·Tmax is larger than the rich spike fuel quantity QRS, the CPU 38 calculates the valve open time T of the electromagnetic valve 34 by dividing the rich spike fuel quantity QRS by the purged vapor quantity QV, and sets the fuel injection increased u quantity QF to "0".

In this case, the CPU 38 actualizes the rich spike by controlling the electromagnetic valve 34 in accordance with the valve open time T.

On the other hand, if the purged fuel quantity QV·Tmax is below the rich spike fuel quantity QRS, the CPU 38 sets the valve open time T of the electromagnetic valve 34 to the maximum electromagnetic valve open time Tmax, and sets as the fuel injection increased quantity QF a value (QRS−QV·Tmax) obtained by subtracting the purged fuel quantity QV·Tmax from the rich spike fuel quantity QRS.

In this case, a total quantity of the fuel (a total fuel injection quantity Qtotal) that should be injected from the fuel injection valve 9, is a value (Q+QF) obtained by adding the fuel injection quantity Q calculated from the fuel injection quantity control map to the fuel injection increased quantity QF, and it is therefore required for actualizing this total fuel injection quantity Qtotal that the fuel injection time is prolonged by starting the fuel injection earlier than the fuel injection timing IT calculated from the fuel injection timing control map.

Figure 4:
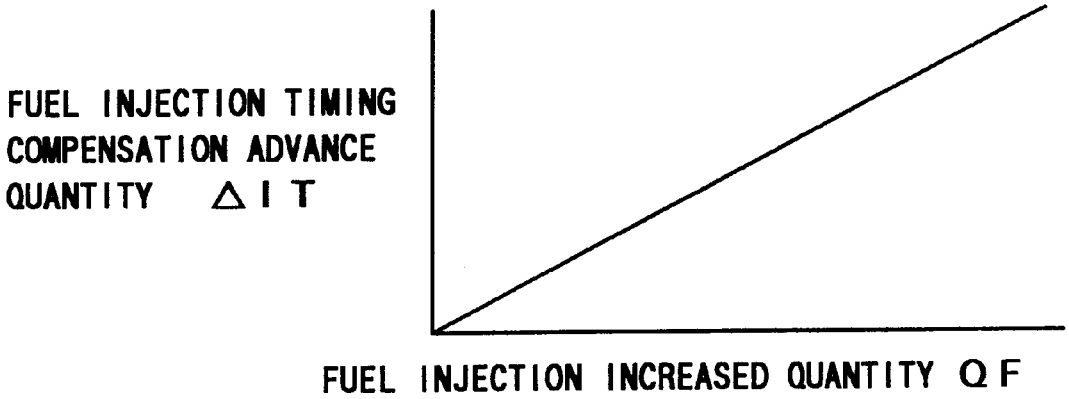
FIG. 4 is a graphic chart showing a specific example of a fuel injection timing compensation map.

On this occasion, the CPU 38 calculates the fuel injection timing compensation advance quantity ΔIT corresponding to the fuel injection increased quantity QF from the fuel injection timing compensation map as shown in FIG. 4, then adds the fuel injection timing IT to the fuel injection timing compensation advance quantity ΔIT, thus calculates a fuel injection timing ITtotal when executing the rich spike. Then, the CPU 38 actualizes the rich spike by controlling the fuel injection valve 9 in accordance with the fuel injection timing ITtotal.

When actualizing the rich spike under the above-described controls, especially when executing the rich spike during the lean operation of the stratified combustion, the air-fuel ratio in the combustion chamber abruptly changes to the rich state due to the purging of the vapor fuel gas and the fuel injection increased quantity, there might occur an accidental fire caused by the rich state. Therefore, the CPU 38 regulates the fuel quantity changing velocity due to the purging of the vapor fuel gas and also the fuel quantity changing velocity due to the fuel injection increased quantity so that a changing velocity of the total fuel quantity obtained by summing the fuel quantity in the purged vapor fuel gas and the injection fuel quantity, becomes a changing velocity not enough to induce the accidental fire by the rich state.

Note that the CPU 38, when executing the rich spike control based on the fuel injection increased quantity, may inhibit the stratified combustion control and instead may perform the uniform combustion control, aiming at stabilizing the combustion within each cylinder 2.

Thus, the CPU 38 actualizes gas state judging means and exhaust state control means according to the present invention by executing the application program in the ROM 39.

Operation and effects of this embodiment will hereinafter be described.

Figure 5:
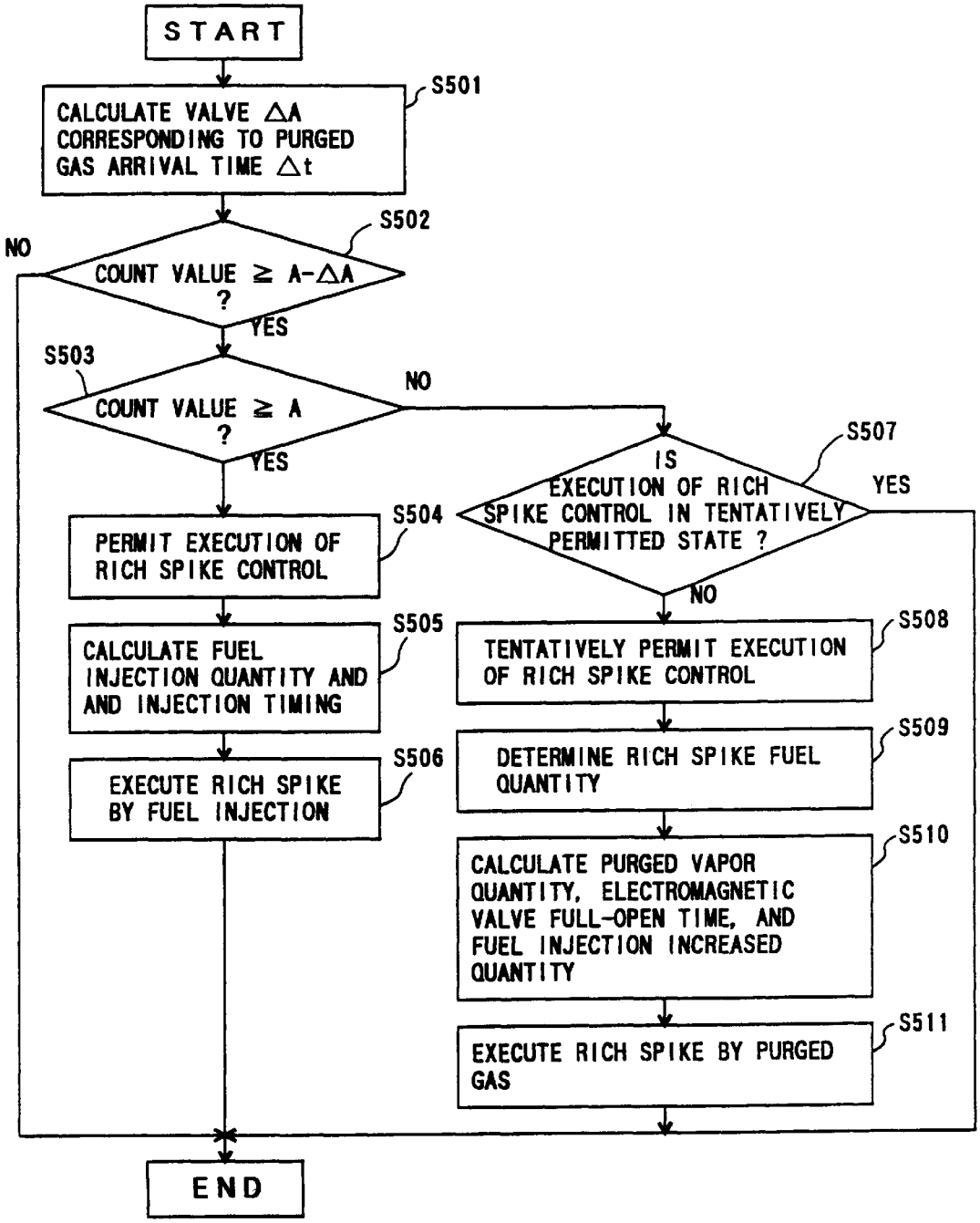
FIG. 5 is a flowchart showing a nitrogen oxide purifying control routine.

The CPU 38 executes, when executing the stratified combustion control of the internal combustion engine 1, the nitrogen oxide purifying control routine as shown in FIG. 5 at an interval of a predetermined time (every time the crank position sensor 13 outputs the signal). In this nitrogen oxide purifying control routine, the CPU 38, to begin with, in S501, accesses the RAM 40 and reads the number-of-engine-rotations N therefrom. Subsequently, the CPU 38 accesses the purged gas arrival time control map in the ROM 39, then calculates the purged gas arrival time Δt corresponding to the number-of-engine-rotations N, and calculates the value ΔA corresponding to the purged gas arrival time Δt.

Next, the CPU 38 advances to S502 and subtracts the value ΔA calculated in S501 from the upper limit value A of the rich spike execution counter. Then, the CPU 38 judges whether or not the counter value of the rich spike execution counter is above the value (A−ΔA) obtained by the above subtraction process.

The CPU 38, when judging in S502 that the counter value of the rich spike execution counter is below the subtracted result (A−ΔA), temporarily finishes this routine.

While on the other hand, the CPU 38, when judging in S502 that the counter value of the rich spike execution counter is over the subtracted result (A−ΔA), advances to S503 and judges whether or not the counter value of the rich spike execution counter is over the upper limit value A, i.e., whether or not the nitrogen oxide $NO_x$ occluded quantity of the $NO_x$ occluded catalyst 28 is in the saturated state.

The CPU 38, when judging in S503 that the counter value of the rich spike execution counter is below the upper limit value A, advances to S507 and judges whether or not the execution of the rich spike control is in a tentatively permitted state. The tentatively permitted state of the rich spike control execution, which is connoted herein, refers to a state before executing the rich spike control based on the fuel injection increased quantity and a state where the rich spike control is being executed based on the purging of the vapor fuel gas.

In the RAM 40, a rich spike control execution tentative permission flag region is set to "1" when starting the execution of the rich spike control based on the purging of the vapor fuel gas, and re-set to "0" when finishing the execution of the rich spike control based on the purging of the vapor fuel gas. Then, the CPU 38 may judge whether or not the execution of the rich spike control is in the tentatively permitted state by judging whether the "1" or "0" is stored in the rich spike control execution tentative permission flag region.

The CPU 38, when judging in S507 that the execution of the rich spike control is not in the tentatively permitted state, advances to S508, and sets "1" in the rich spike control execution tentative permission flag region in the RAM 40.

Next, the CPU 38 moves forward to S509 and determines the fuel increased quantity (the rich spike fuel quantity QRS) needed for desorbing and purifying the nitrogen oxide $NO_x$ occluded in the $NO_x$ occluded catalyst 28. On this occasion, the CPU 38 determines the rich spike fuel quantity QRS on the assumption that the counter value of the rich spike execution counter reaches the upper limit value A.

Then, the CPU 38, upon advancing to S510, calculates the quantity of fuel purged per unit time (the purged vapor quantity QV) by multiplying the purged gas flow rate QP per unit time by the fuel concentration CP. Subsequently, the CPU 38 calculates the purged fuel quantity QV·Tmax by multiplying the purged vapor quantity QV by the maximum electromagnetic valve open time Tmax, and determines the valve open time T of the electromagnetic valve 34 and the fuel injection increased quantity QF on the basis of the purged fuel quantity QV·Tmax and the rich spike fuel quantity QRS calculated in S509.

On this occasion, the CPU 38 compares the purged fuel quantity QV·Tmax with the rich spike fuel quantity QFS, and, if the purged fuel quantity QV·Tmax is larger than the rich spike fuel quantity QRS, calculates the electromagnetic valve open time T by dividing the rich spike fuel quantity QRS by the purged vapor quantity QV, and then resets the fuel injection increased quantity QF to "0".

On the other hand, if the purged fuel quantity QV·Tmax is below the rich spike fuel quantity QRS, the CPU 38 sets the electromagnetic valve open time T to the maximum electromagnetic valve open time Tmax, and sets the fuel injection increased quantity QF to a value (QRS−QV·Tmax) obtained by subtracting the purged fuel quantity QV·Tmax from the rich spike fuel quantity QRS.

The CPU 38 makes the RAM 40 store the thus calculated electromagnetic valve open time T and the fuel injection increased quantity QF in predetermined areas, and thereafter advances to S511. In S511, the CPU 38, in order to execute the rich spike based on the purging of the vapor fuel gas, sets the electromagnetic valve 34 in the full-open state, and temporarily finishes this routine.

Thereafter, the CPU 38 resumes the execution of this routine and, when judging in S502 and S503 that the counter value of the rich spike execution counter is above the value (A−ΔA) and below the value A. This leads the CPU 38 to such a judgement made in S507 that the execution of the rich spike control is in the tentatively permitted state, and the CPU 38 temporarily finishes the execution of the present routine.

This routine is thus repeatedly executed, and the CPU 38, when judging in S503 that the counter value of the rich spike execution counter is over the upper limit value A, advances to S504.

In S504, the CPU 38 writes "1" to the rich spike control execution permission flag region set in the RAM 40. It is assumed that "1" is set in the rich spike control execution tentative permission flag region when starting the execution of the rich spike control based on the fuel injection increased quantity, and "0" is set therein when finishing the execution of the rich spike control based on the fuel injection increased quantity.

Subsequently, the CPU 38 advances to S505 and calculates the total fuel injection quantity Qtotal and the fuel injection timing ITtotal on the basis of the fuel injection quantity Q determined by the fuel injection quantity control routine, the fuel injection timing IT determined by the fuel injection timing control routine, the fuel injection increased quantity QF determined in S510 and the fuel injection timing compensation map.

Then, the CPU 38 advances to S506, wherein the CPU 38, for executing the rich spike based on the fuel injection increased quantity, switches over the control to the uniform combustion control from the stratified combustion control, and controls the fuel injection valve 9 in accordance with the total fuel injection quantity Qtotal and the fuel injection timing ITtotal which have been calculated in S505.

According to the embodiment described above, the rich spike control is carried out so that the fuel injection increased quantity and the vapor fuel gas arrive at the $NO_x$ occluded catalyst 28 substantially at the same timing, and therefore it follows that the vapor fuel gas presents within the combustion chamber 5 at the same timing as the fuel injected by the fuel increased quantity. Namely, the vapor fuel gas is, after the internal combustion engine 1 has shifted to the uniform combustion state from the stratified combustion state, led into the combustion chamber 5, whereby the combustion in the internal combustion engine 1 can be stabilized without interfering with the stratified combustion.

Furthermore, the fuel injection quantity is increased according to the state of the vapor fuel gas, so that nitrogen oxide $NO_x$ occluded in the $NO_x$ occluded catalyst 28 can be desorbed and purified with the minimum fuel injection increased quantity required, and that the air-fuel mixture cannot be in an excessively rich state. As a consequence, the combustion of the air-fuel mixture is stabilized, and the increase in the fuel consumption by the rich spike control is restrained.

Moreover, the vapor fuel adsorbed to the canister is utilized for the rich spike, and hence there might be more chances to purge the vapor fuel, and it is feasible to surely regenerate the canister.

<Another Embodiment>

Figure 6:
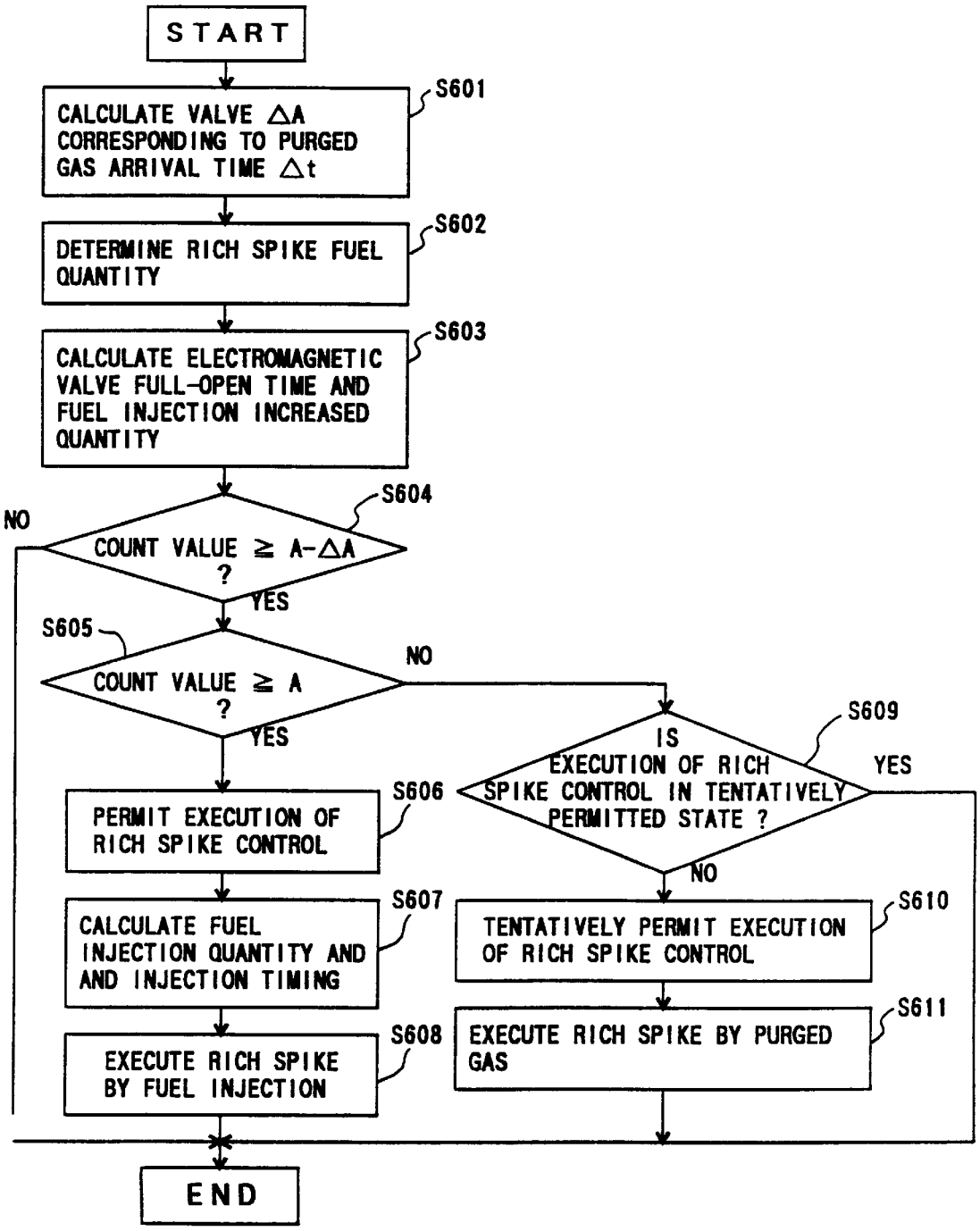
FIG. 6 is a flowchart showing the nitrogen oxide purifying control routine in another embodiment.

Another embodiment of the exhaust gas purifying apparatus according to the present invention will hereinafter be described by referring to FIG. 6. FIG. 6 is a flowchart showing the nitrogen oxide purifying control routine in this embodiment.

In the nitrogen oxide purifying control routine shown in the embodiment described above, the rich spike fuel quantity QRS, the valve open time T of the electromagnetic valve 34 and the fuel injection increased quantity QF, are determined just when the execution of the rich spike control is tentatively permitted. By contrast, in the nitrogen oxide purifying control routine shown in FIG. 6, the rich spike fuel quantity QRS, the valve open time T of the electromagnetic valve 34 and the fuel injection increased quantity QF, are determined before the execution of the rich spike control is tentatively permitted.

That is, the CPU 38, in S601, accesses the RAM 40 and reads the number-of-engine-rotations N therefrom. Subsequently, the CPU 38 accesses the purged gas arrival time control map in the ROM 39, then calculates the purged gas arrival time Δt corresponding to the number-of-engine-rotations N, and calculates the value ΔA corresponding to the purged gas arrival time Δt.

Subsequently, the CPU 38 advances to S602 and determines the fuel increased quantity (the rich spike fuel quantity QRS) necessary for desorbing and purifying the nitrogen oxide $NO_x$ occluded in the $NO_x$ occluded catalyst 28. On this occasion, the CPU 38 determines the rich spike fuel quantity QRS on the assumption that the counter value of the rich spike execution counter reaches the upper limit value A.

Then, the CPU 38, when advancing to S603, detects the purged gas flow rate QP per unit time and the fuel concentration CP, and calculates the quantity of fuel purged per unit time (the purged vapor quantity QV) by multiplying the purged gas flow rate QP by the fuel concentration CP.

Subsequently, the CPU 38 calculates the purged fuel quantity QV·Tmax by multiplying the purged vapor quantity QV by the maximum electromagnetic valve open time Tmax, and determines the valve open time T of the electromagnetic valve 34 and the fuel injection increased quantity QF on the basis of the purged fuel quantity QV·Tmax and the rich spike fuel quantity QRS calculated in S509.

At this time, the CPU 38 compares the purged fuel quantity QV·Tmax with the rich spike fuel quantity QRS, and, if the purged fuel quantity QV·Tmax is larger than the rich spike fuel quantity QRS, calculates the electromagnetic valve open time T by dividing the rich spike fuel quantity QRS by the purged vapor quantity QV, and then resets the fuel injection increased quantity QF to "0".

On the other hand, if the purged fuel quantity QV·Tmax is below the rich spike fuel quantity QRS, the CPU 38 sets the electromagnetic valve open time T to the maximum electromagnetic valve open time Tmax, and sets the fuel injection increased quantity QF to a value (QRS−QV·Tmax) obtained by subtracting the purged fuel quantity QV·Tmax from the rich spike fuel quantity QRS.

The CPU 38 makes the RAM 40 store the thus calculated electromagnetic valve open time T and the fuel injection increased quantity QF in predetermined areas.

Next, the CPU 38 advances to S604, and subtracts the value ΔA calculated in S601 from the upper limit value A of the rich spike execution counter. Then, the CPU 38 judges whether or not the counter value of the rich spike execution counter is over the value (A−ΔA) obtained by the above subtraction process.

The CPU 38, when judging in S604 that the counter value of the rich spike execution counter is below the subtracted value (A−ΔA), temporarily finishes this routine.

On the other hand, the CPU 38, when judging in S604 that the counter value of the rich spike execution counter is over the subtracted result (A−ΔA), advances to S605 and judges whether or not the counter value of the rich spike execution counter is over the upper limit value A, i.e., whether or not the nitrogen oxide $NO_x$ occluded quantity of the $NO_x$ occluded catalyst 28 is in the saturated state.

The CPU 38, when judging in S605 that the counter value of the rich spike execution counter is below the upper limit value A, advances to S609. In S609, the CPU 33 accesses the rich spike control execution tentative permission flag region in the RAM 40, and judges whether "1" or "0" is stored therein.

The CPU 38, when judging in S609 that "0" is stored in the rich spike control execution tentative permission flag region and that the execution of the rich spike control is not in the tentatively permitted state, advances to S610 and sets "1" in the rich spike control execution tentative permission flag region.

Subsequently, the CPU 38 advances to S611, in which the CPU 38 accesses the predetermined region in the RAM 40 and reads the electromagnetic valve open time T calculated in S603. Then, the CPU 38, for executing the rich spike based on the purging of the vapor fuel gas, performs the control so that the electromagnetic valve 34 remains in the full-open state for the duration of the electromagnetic valve open time T, and temporarily finishes this routine.

Thereafter, the CPU 38 resumes the execution of this routine and, when judging in S604 and S605 that the counter value of the rich spike execution counter is over the value (A−ΔA) and below the value A. This leads the CPU 38 to such a judgement made in S609 that the execution of the rich spike control is in the tentatively permitted state, and the CPU 38 temporarily finishes the execution of the present routine.

This routine is thus repeatedly executed, and the CPU 38, when judging in S605 that the counter value of the rich spike execution counter is over the upper limit value A, advances to S606.

In S606, the CPU 38 sets "1" in the rich spike control execution permission flag region in the RAM 40, and advances to S607.

In S607, the CPU 38 calculates the total fuel injection quantity Qtotal and the fuel injection timing ITtotal on the basis of the fuel injection quantity Q determined by the fuel injection quantity control routine, the fuel injection timing IT determined by the fuel injection timing control routine, the fuel injection increased quantity QF determined in S603 and the fuel injection timing compensation map.

Then, the CPU 38 advances to S608, wherein the CPU 38, in order to execute the rich spike based on the fuel injection increased quantity, switches over the control to the uniform combustion control from the stratified combustion control, and controls the fuel injection valve 9 in accordance with the total fuel injection quantity Qtotal and the fuel injection timing ITtotal which have been calculated in S607.

According to the embodiment described above, the same effects as those of the preceding embodiment can be obtained.

Figure 7:
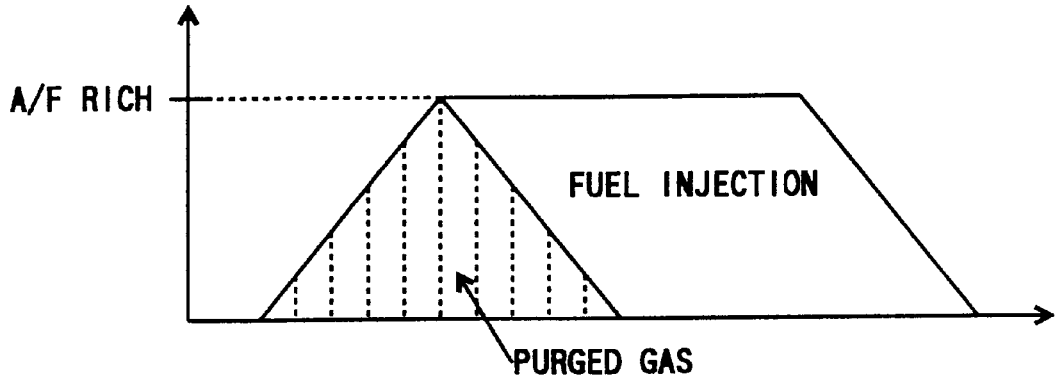
FIG. 7 is an explanatory graphic chart showing a rich spike method in another embodiment.
Figure 8:
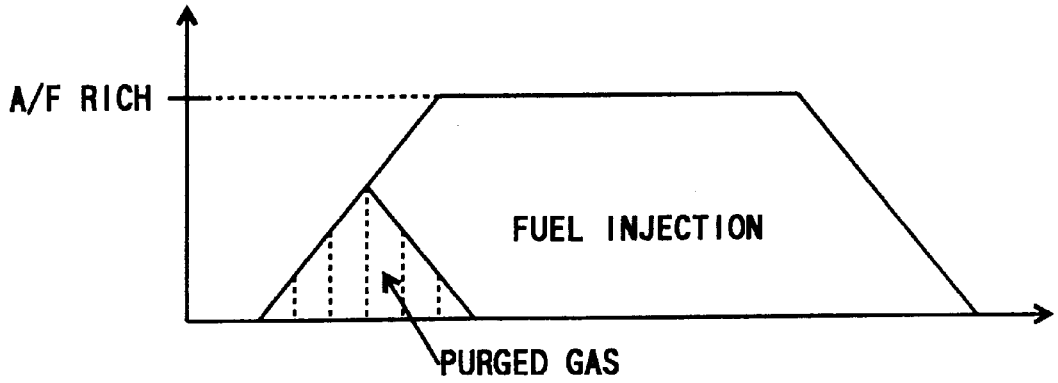
FIG. 8 is an explanatory graphic chart showing another rich spike method in another embodiment.

Note that in the two embodiments described above, the example of performing the control so that the increased quantity of injection fuel and the vapor fuel gas substantially simultaneously flow to the $NO_x$ occluded catalyst has been exemplified as the method of selectively controlling the fuel injection valve and the electromagnetic valve. As shown in FIGS. 7 and 8, however, an alternative control method is that the exhaust gas air/fuel ratio based on the purging of the vapor fuel gas is controlled to be rich in the first half of the rich spike, and the fuel quantity deficient for only the purging of the vapor fuel gas is compensated by the increased quantity of the injection by the fuel injection valve in the second half thereof. In this case, it is feasible to reduce the fuel injection quantity required for the rich spike and to surely regenerate the canister.

Figure 9:
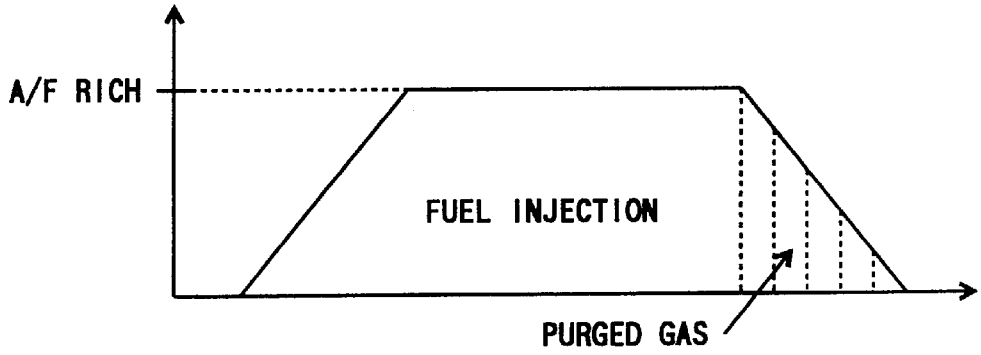
FIG. 9 is an explanatory graphic chart showing still another rich spike method in another embodiment.

Further, as shown in FIG. 9, the exhaust gas air/fuel ratio may be controlled to be rich based on the fuel injection quantity in the first half of the rich spike, and the exhaust gas air/fuel ratio may be controlled to be rich based on the purging of the vapor fuel gas in the second half thereof.

Figure 10:
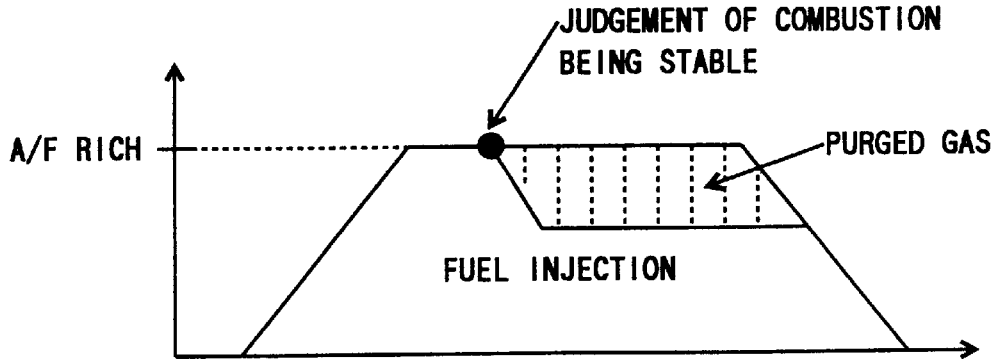
FIG. 10 is an explanatory graphic chart showing a further rich spike method in another embodiment.

Moreover, as illustrated in FIG. 10, the exhaust gas air/fuel ratio may be controlled to be rich based on only the fuel injection quantity in the first half of the rich spike, and the air/fuel ratio in the combustion chamber is set to such an air/fuel ratio as to stabilize the combustion (e.g., the theoretical air/fuel ratio), and, subsequently, the fuel injection increased quantity and the purging of the vapor fuel gas may be performed in parallel. In this case, the air-fuel mixture in the vicinity of the theoretical air/fuel ratio is burned, whereby the fuel injection quantity and the purging of the vapor fuel gas are easily feedback-controlled based on the output signal of the air/fuel ratio sensor in order to set the air/fuel ratio of the air-fuel mixture (or the exhaust gas) to a desired air/fuel ratio, so that the accidental fire caused by the rich state due to the purging of the vapor fuel gas can be prevented, and the rich spike can be actualized without making the combustion unstable.

The method of selectively controlling the fuel injection valve and the electromagnetic valve is not limited to the above-described examples, but it is preferable to select an optimal method in accordance with the operation state of the internal combustion engine and the state of the vapor fuel gas.

The many features and advantages of the invention are apparent from the detailed description and, thus, it is intended by the appended claims to cover all such features and advantages of the invention which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An exhaust gas purifying apparatus of a lean-burn internal combustion engine, comprising:

a lean-burn internal combustion engine capable of burning an air-fuel mixture in an oxygen excessive state;

gas supply means for supplying an intake system of said lean-burn internal combustion engine with a vapor fuel gas containing a vapor fuel generated in a fuel tank;

a nitrogen oxide occluding/reducing catalyst, provided in an exhaust system of said lean-burn internal combustion engine, for occluding nitrogen oxide in the exhaust gas when the exhaust gas is in the oxygen excessive state, and purifying the occluded nitrogen oxide when an oxygen concentration in the exhaust gas decreases;

gas state judging means for judging a state of the vapor fuel gas supplied to the intake system of said lean-burn internal combustion engine; and exhaust state control means for setting, to a desired state, an air/fuel ratio of the exhaust gas flowing to said nitrogen oxide occluding/reducing catalyst by selectively controlling a fuel injection valve of said lean-burn internal combustion engine and said gas supply means in accordance with the state of the vapor fuel gas which is judged by said gas state judging means at a timing when the nitrogen oxide occluded by said nitrogen oxide occluding/reducing catalyst should be purified.

2. An exhaust gas purifying apparatus of a lean-burn internal combustion engine according to claim 1, wherein said gas state judging means includes vapor fuel concentration judging means for judging a fuel concentration in the vapor fuel gas supplied by said gas supply means to the intake system of said lean-burn internal combustion engine.

3. An exhaust gas purifying apparatus of a lean-burn internal combustion engine according to claim 1, wherein said gas state judging means includes gas supply quantity judging means for judging a quantity of the vapor fuel gas supplied by said gas supply means to the intake system of said lean-burn internal combustion engine.

4. An exhaust gas purifying apparatus of a lean-burn internal combustion engine according to claim 1, wherein said gas state judging means includes gas arrival time judging means for judging a time required for the vapor fuel gas to arrive at said nitrogen oxide occluding/reducing catalyst from the time when said gas supply means has started supplying the vapor fuel gas to the intake system of said lean-burn internal combustion engine.

5. An exhaust gas purifying apparatus of a lean-burn internal combustion engine according to claim 1, wherein said exhaust gas state control means selectively controls a period of time of fuel injection by said fuel injection valve, a timing of fuel injection by said fuel injection valve, a supply quantity of the vapor fuel gas by said gas supply means, and a supply timing of the vapor fuel gas by said gas supply means.

6. An exhaust gas purifying apparatus of a lean-burn internal combustion engine according to claim 1, wherein said lean-burn internal combustion engine is a cylinder injection type lean-burn internal combustion engine including a fuel injection valve for injecting the fuel directly into a cylinder, and said exhaust gas state control means changes the fuel injection timing of said fuel injection valve to the time of an intake stroke of each cylinder, when the fuel injection timing of said fuel injection valve is set at a compression stroke of each cylinder, for purifying the nitrogen oxide occluded by said nitrogen oxide occluding/reducing catalyst.

* * * * *